US005743278A

United States Patent [19]

Ookura et al.

[11] Patent Number: 5,743,278

[45] Date of Patent: Apr. 28, 1998

[54] METHOD OF AND TOOL FOR HAIR TREATMENT

[75] Inventors: Hiroyuki Ookura; Shigeya Yamakawa, both of Nagoya, Japan

[73] Assignee: Shigeya Yamakawa, Japan

[21] Appl. No.: 641,753

[22] Filed: May 2, 1996

[30] Foreign Application Priority Data

| | | | |
|---|---|---|---|
| May 10, 1995 | [JP] | Japan | 7-111790 |
| Jun. 27, 1995 | [JP] | Japan | 7-160757 |
| Jul. 10, 1995 | [JP] | Japan | 7-173432 |

[51] Int. Cl.[6] ..... A45D 7/00

[52] U.S. Cl. ..... 132/210; 132/200; 132/207; 132/118; 132/229; 219/224

[58] Field of Search ..... 132/210, 211, 132/207, 118, 119, 119.1, 231, 234, 229, 227, 220, 244, 263; 219/200, 222, 224, 225

[56] References Cited

U.S. PATENT DOCUMENTS

| | | | |
|---|---|---|---|
| 2,152,342 | 3/1939 | Bezzenberger | 219/224 |
| 2,152,344 | 3/1939 | Brown | 219/224 |
| 2,288,369 | 6/1942 | Poniatoff | 219/224 |
| 3,851,654 | 12/1974 | Kober | 132/229 |
| 4,702,265 | 10/1987 | Weddington | 132/118 |

FOREIGN PATENT DOCUMENTS

| | | | |
|---|---|---|---|
| 918673 | 2/1947 | France | 219/224 |

*Primary Examiner*—Gene Mancene
*Assistant Examiner*—Philogene Pedro
*Attorney, Agent, or Firm*—Palmatier, Sjoquist, Helget & Voigt, P.A.

[57] ABSTRACT

The invention concerns a hair treatment method using a hair treatment liquid having been electrolytically treated by passing current through hair. The hair treatment method features applying a hair treatment liquid to hair and electrolytically treating the applied hair treatment liquid by passing current through the hair. The invention also concerns a hair treatment tool which is substantially made of an insulating material and features that an anode electrode bar and a cathode electrode bar both connected to a power supply are disposed such as to be in contact with hair, the hair having been imparted with conductivity being pinched between the two electrode bars to pass current through the pinched hair.

7 Claims, 10 Drawing Sheets

METHOD OF AND TOOL FOR HAIR TREATMENT

BACKGROUND OF THE INVENTION

1. Field of the Invention

This invention relates to hair treatments, such as permanent waving treatment including straightening treatment, hair conditioning, dyeing, etc. More particularly, the invention concerns a method of hair treatment using a hair treatment liquid having been electrolytically treated by passing current therethrough and a hair treatment tool used for the same method.

2. Description of the Prior Art

As typical hair treatments, permanent waving, i.e., waving straight hair, and permanent straightening, i.e., straightening curled hair, are well-known in the art. In the usual method of permanent straightening treatment, hair to which a first permanent waving agent (hereinafter referred to as first agent) mainly composed of a reducing agent is applied, is straightened by applying the hair to a plurality of elongate sheets or combing out the hair with a comb for a long time to cut disulfide (S—S) bonds between keratin molecules of the hair with a reducing action of the first agent, and then a second permanent waving agent (hereinafter referred to as second agent) containing an oxidizing agent as a neutralizer is applied to the hair to generate S—S bonds between cysteine residues with an oxidizing action of the second agent so as to make the new hair form stable. The treatment with the first and second agents is also done in the usual permanent waving treatment.

However, when the oxidizing treatment with the second agent is insufficient in the above permanent waving treatment, the S—S bonds cannot be generated. As a result, amino acid components flow away from hair, thus resulting in commonly called damaged hair. Therefore, in the usual permanent waving treatment method, usually 20 to 40 minutes is necessary as the time of the hair treatment with the first and second agents, respectively, and 15 to 25 minutes is necessary as a subsequent time of leaving the hair. That is, a total of about 70 to 100 minutes is required, and the efficiency of operation is very bad.

For adequately setting the above treatment times, high skill and long experience are required for the operator. This leads to high permanent waving fee and also constitutes a reason why one can not easily make permanent waving treatment at home. In addition, because of the long permanent waving treatment time as noted, the odor of the permanent waving agent containing the first and second agents remains after the treatment, thus making the treated person uncomfortable. A further inconvenience is that the first and second agents tend to be used excessively in order to make effective permanent waving treatment.

Another typical hair treatment daily hair conditioning including care of damaged hair. Usual hair conditioning treatment that is done after bath taking or after every morning hair washing, is to apply a hair treatment liquid such as a hair conditioner to hair and then dry the hair with a hair drier.

However, drying hair with a hair drier extremely deteriorates the hair and/or generates damaged hair. In addition, the hair conditioning effect that is obtainable with the above hair treatment is comparatively quickly faded out. Moreover, with an oily or viscous hair conditioner, a hair conditioning effect of protecting hair against damage can be hardly expected even by daily use of the hair conditioner.

In the meantime, when dyeing hair by using an acidic hair dyeing agent, a problem is posed that the pigment component of the dye is not easily dissociated into ions and that the dye molecules tend to associate with one another. Consequently, the permeation of dye molecules into the keratin layer of hair is insufficient, making it difficult to maintain the dyeing effect for a long time.

The general hair treatment as described above and also chemicals used therefor are generally described in, for instance, "Cosmetics: Science and Technology", Second Edition, edited by M. S. Balsam and E. Sagarin and published by Wiley-Interscience (1972), "CTFA Cosmetic Ingredients Dictionary", Third Edition, edited by N. F. Estrin and published by Cosmetic, Toiletry, and Fragrance Association (1982), and "Harry's Cosmeticology", Seventh Edition, supervised by R. G. Harry, edited by J. B. Wilkinson and R. J Moore and published by Chemical Publishing (1982).

SUMMARY OF THE INVENTION

The invention has been created in order to solve the above various problems inherent in the prior art, and it has an object of providing a method of and a tool for hair treatment which permit:

i) readily carrying out a permanent waving treatment in a reduced treatment time and by suppressing damage to hair due to a reducing treatment;

ii) maintaining an effect of hair conditioning such as care of damaged hair; and iii) increasing the hair dyeing efficiency and retaining the dyed color for a long time.

The method of hair treatment according to the invention features the use of a hair treatment liquid which has been electrolytically treated by passing current therethrough. In the method according to the invention, a desired hair treatment is done by using a hair treatment liquid of which various active components have been activated through an electrolytic treatment. It is thus possible to increase a desired hair treatment effect compared to the prior art method without increasing the amount of hair treatment liquid applied to hair.

In the present specification, the term "hair treatment" is intended to mean general activities of handling hair for the health and sanitation and/or hair dressing purpose, such as various permanent waving treatments including hair straightening, various hair conditioning treatments including care of damaged hair, hair dyeing, hair washing, and elimination of harmful parasitic vermin such as ticks and lice. Thus, the term "hair treatment liquid" as used in the present specification means general aqueous liquids which can be used for the hair treatment, and does not mean any particular chemicals. This means that conditioned water for wetting hair is included in the hair treatment liquids in the present specification so long as it is used for the hair treatment.

The activation of the hair treatment liquid which can be suitably attained under the method of hair treatment according to the invention, is to enhance the oxidizing capacity of an oxidizer contained in the hair treatment liquid, or to dissociate and/or ionize molecules contained in the hair treatment liquid.

In one preferred form of the method of hair treatment according to the invention, the hair treatment liquid which is electrolytically treated by passing current therethrough is a neutralizer (second agent noted above) for permanent waving treatment. According to this form of the invention, the oxidizing capacity of the oxidizer contained in the neutralizer for the permanent waving treatment is enhanced to promote the oxidizing action. It is thus possible to neutralize the first agent noted above applied to hair and carry out the hair oxidizing treatment quickly without increasing the amount of the second agent applied to the treated hair in the permanent waving treatment.

In an another preferred form of the method of hair treatment according to the invention, the hair treatment liquid electrolytically treated by passing current therethrough is an oxidizing hair dye. According to this form of the invention, the oxidizing action of the oxidizing agent can be promoted, thus permitting hair dyeing in a short period of time.

In a further preferred form of the method of hair treatment according to the invention, the hair treatment liquid electrolytically treated by passing current therethrough is a hair conditioning liquid or an acidic hair dye. According to this form of the invention, it is possible to obtain, through electrolytic treatment, the dissociation of molecules contained in the hair conditioning liquid or acidic hair dye. The active components of the hair conditioning liquid or dyeing components of the dye thus can quickly permeate hair, and it is thus possible to maintain the hair conditioning effect or dyeing effect for a long time.

A still further preferred form of the method of hair treatment according to the invention is one which features applying a hair treatment liquid to hair to impart the hair with conductivity and electrolytically treating the hair treatment liquid applied to the hair by passing current through the hair. According to this form of the invention, since the hair treatment liquid is electrolytically treated on hair, the activated components of the liquid are not lost with the lapse of time after the electrolytic treatment, and the hair treatment liquid having been activated in the electrolytic treatment can be quickly provided to the entire hair.

A yet further preferred form of the invention uses a hair treatment tool, which is made of an insulating material and features that an anode electrode bar and a cathode electrode bar both connected to a power supply are disposed such as to be in contact with hair. Hair which has been imparted with conductivity is pinched between the two electrode bars to pass a minute current through the pinched hair. According to this form of the invention, the electrolytic treatment of the hair treatment liquid on hair can be done easily and quickly by using the above tool.

By the term "power supply" used in the present specification are meant general devices for providing DC current, including various kinds of batteries and converters with transformers.

According to the invention, a hair treatment tool is further provided, which is made of a substantially insulating material and features that an anode electrode bar and a cathode electrode bar both connected to a power supply are disposed such as to be in contact with hair imparted with conductivity, the hair being clamped between the two electrode bars to pass current through the hair. The hair treatment tool having the above features according to the invention can quickly and easily electrolytically treat the hair treatment liquid applied to the hair, thus causing the active components in the hair treatment liquid having been made active through the electrolytic treatment to permeate the hair quickly and effectively.

A preferred form of the hair treatment tool according to the invention is a hair iron which has the anode electrode bar disposed on a meshing surface of one pinching part and the cathode electrode bar disposed on a meshing surface of the other pinching part. According to this form of the invention, current can be passed through the treatment hair with the hair treatment liquid applied thereto by pinching the hair between the meshing surfaces. Thus, first agent noted above, for instance, may be neutralized while enhancing its oxidizing capacity without increasing the amount of the second agent added in the second agent treatment step in the permanent straightening treatment of hair.

The present invention will be more fully understood from the following detailed description and appended claims when taken with the accompanying drawings.

DETAILED DESCRIPTION OF THE PREFERRED EMBODIMENTS

The method of and tool for hair treatment according to the invention are applicable to various hair treatments. Typically, the invention can be carried out as follows.

(1) Permanent waving treatment

In the permanent waving treatment, the first agent may be applied to hair in a manner as in the prior art permanent waving treatment method, and no special operation is needed to carry out the invention. The first agent suitable for carrying out the invention is an aqueous solution or a highly viscous creamy solution which contains, as a reducing agent or main component, thioglycolic acid, thioglycolic acid compound, cysteine compound, mercaptocarboxylic acid, mercaptopropionic acid compound, or a mixture of these compounds, and the pH of which is adjusted to 9.0 to 9.5 by adding, as alkaline agent, ammonia water, ammonium compound, other inorganic alkaline compound, amine or a mixture of these compounds.

The second agent that can be used suitably for carrying out the invention contains, as an oxidizing agent, bromic acid compound, iodine acid compound, tannic acid compound, chloric acid compound, inorganic peroxoacid compound, organic peroxoacid compound, nitric acid compound, perhalogen acid compound, halogenous acid compound, hypohalogenous acid compound, inorganic peroxide, organic peroxide, inorganic oxyacid or compound thereof, organic oxyacid or compound thereof, inorganic base, organic base, inorganic halogen compound, organic halogen compound or a mixture of these compounds. To each of the first and second agents may, if necessary, be added a mixture of one or more non-ionic or anionic surface active agents, pH adjuster, lubricant, natural extracts, fragrance, oily components, water-soluble resin, electrolyte, a viscosity increaser, minerals, antiseptic, chelating agent, pigment, etc.

Figure 8:
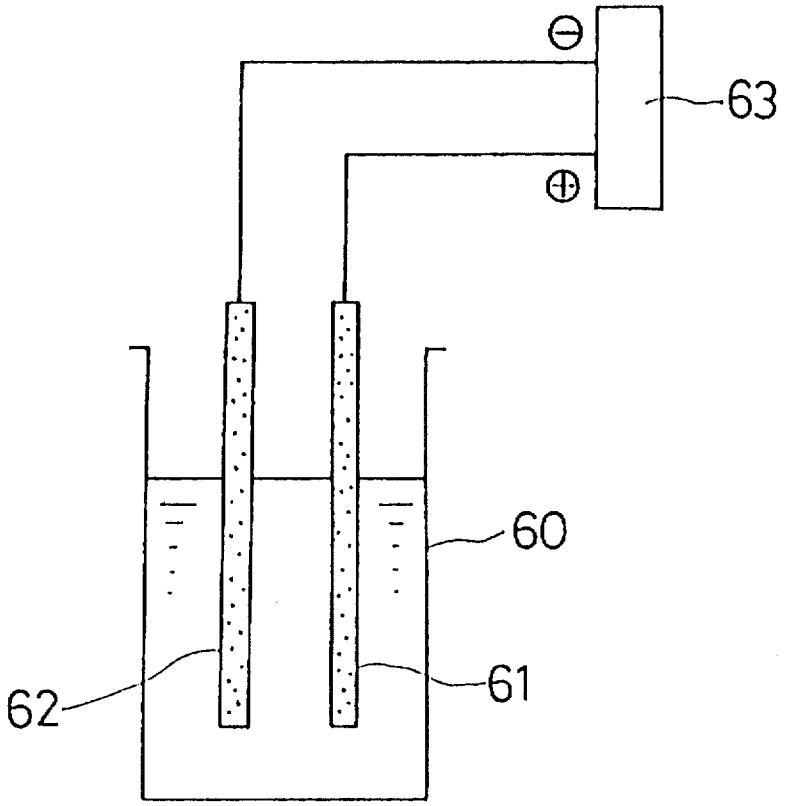
FIG. 8 is a schematic view illustrating a process of electrolytic treatment of a second permanent waving agent used in carrying out the invention.

In carrying out the invention, the second agent is treated as follows. As shown in FIG. 8, the second agent is poured into a vessel 60, and current is passed between an anode electrode 61 of carbon and a cathode electrode 62 also of carbon, these electrodes being connected to a power supply 63 which can output a DC current. A minute current is thus caused to flow in the vessel 60 to effect electrolytic treatment of the second agent. At this time, by dropping a potassium iodide starch solution onto the neighborhood of the electrodes, an increase of the oxidizing capacity of the oxidizing agent can be confirmed from the occurrence of starch-iodine reaction.

The above electrolytic treatment can extremely improve the oxidizing capacity of the second agent. The object (i) mentioned above can be attained by using the second agent having been treated in this way for the permanent waving treatment. In a suitable example of the second agent for increasing the oxidizing power in the above treatment, 5.0 g of sodium chloride, 0.01 g of sodium carbonate, and a slight amount of pigment (Blue No 1, Red No. 104) are contained in 100 ml of an aqueous solution. Through the electric treatment of the second agent, hydrogen and sodium hydroxide are generated at the cathode electrode, chlorine is generated at the anode electrode, and sodium hypochlorite is generated as active oxygen source material by the reaction of the generated chlorine and sodium hydroxide.

In carrying out the invention, it is possible to use chemical means in association with the above electrolytic treatment in order to improve the oxidizing power of the second agent. For example, in the case of using an aqueous solution containing 0.2 g of sodium bromate, 0.428 g of sodium sulfite, 0.798 g of sulfuric acid, 0.68 g of sodium hydroxide and 0.184 g of phosphoric acid, bromic acid is generated by the reaction between the sodium bromate and the sulfuric acid, sulfurous acid is generated by the reaction between the sodium sulfite and the sulfuric acid, and bromine is generated by the reaction between the generated bromic acid and the sulfurous acid. Sodium hypo-bromite as the active oxygen source material is obtained by the reaction between the bromine and the sodium hydroxide. Thus, by applying the above solution as the second agent (i.e., oxidizing agent) to the hair treatment method according to the invention, it is possible to carry out the permanent waving treatment by using the second agent of which the oxidizing capacity is extremely improved by the combined effects of the above chemical reactions and the electrolytic treatment according to the invention.

In lieu of the above method, by using a hair treatment tool according to the invention which is substantially made of an insulating material and which has a feature that an anode electrode bar and a cathode electrode bar both connected to a power supply are disposed such as to be in contact with hair, the second agent having been applied to hair can be electrolytically treated on the hair. By this method, the second agent which has been electrolytically treated to enhance the oxidizing capacity, is momentarily applied to hair, which is greatly effective for the oxidizing treatment of hair.

Figure 1:
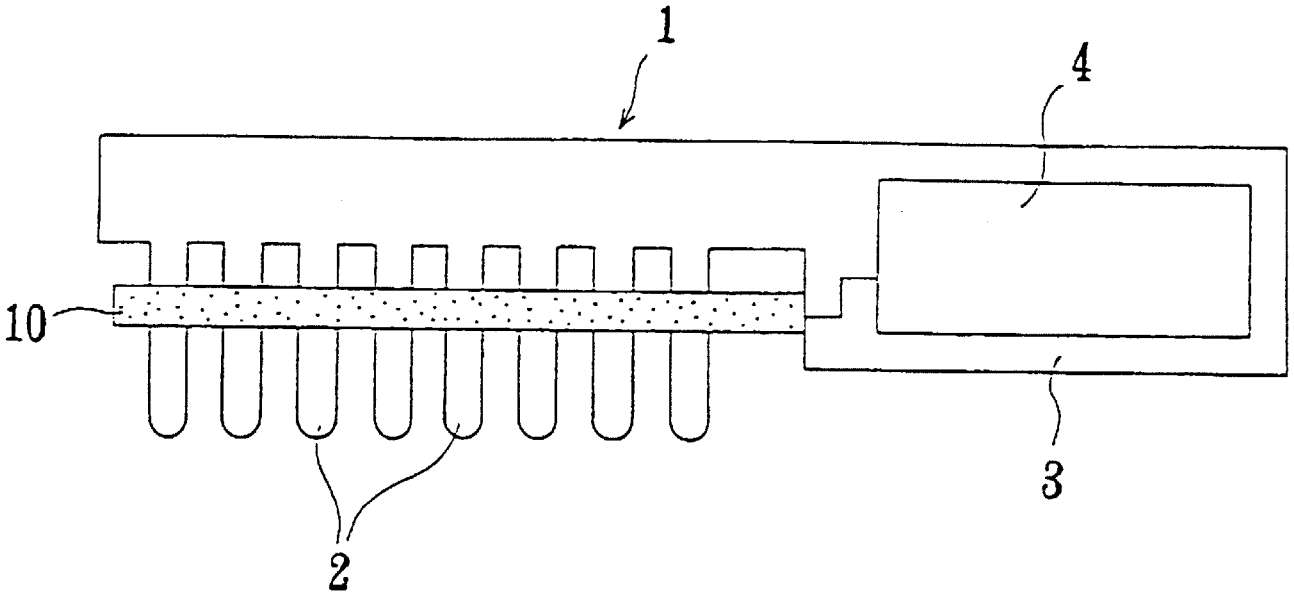
FIG. 1 is a front view of a hair treatment tool according to a preferred embodiment of the invention.
Figure 2:
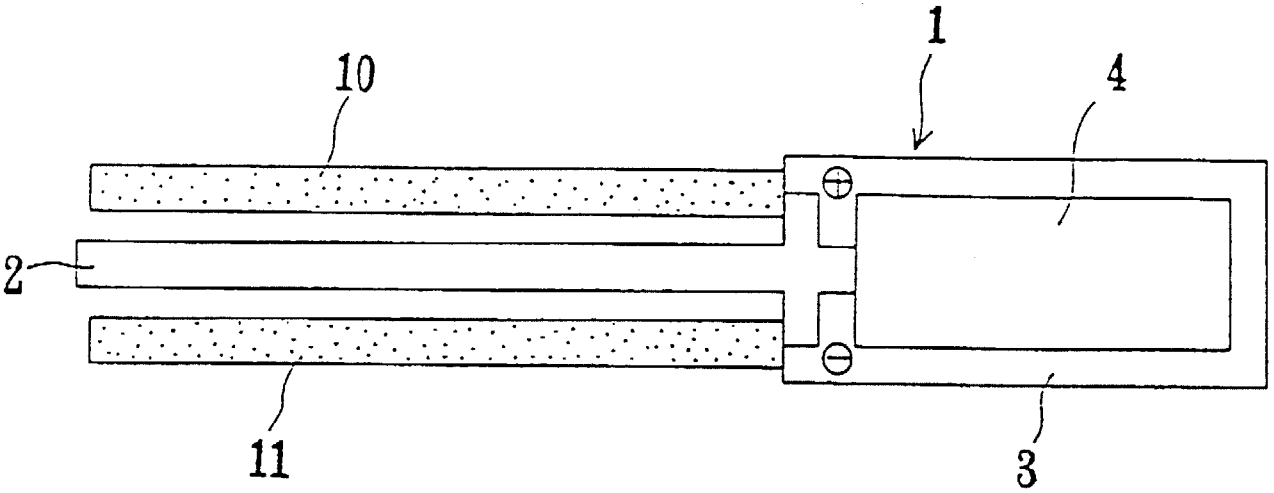
FIG. 2 is a plan view thereof.
Figure 3:
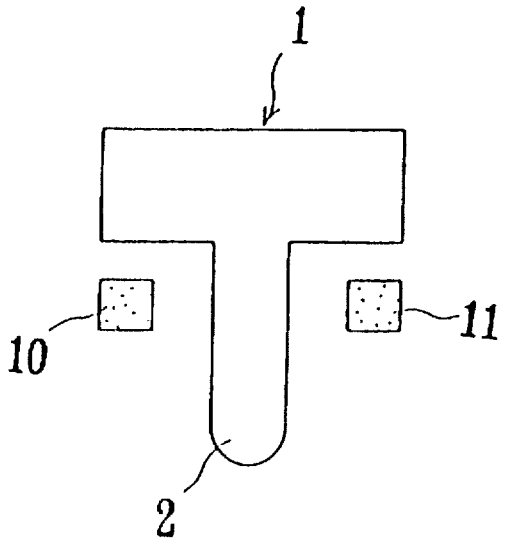
FIG. 3 is a side view thereof.

The hair treatment tool according to the invention which can suitably used for such treatment, is by no means limitative; for instance, it may be one having a comb-like shape as shown in FIGS. 1 to 3. In the drawings, reference numeral 1 designates a tool body, 2 a comb section, and 3 a grip. These parts are all made of an insulating material. Reference numeral 4 in the drawings designates a power supply accommodated in the grip 3. On the opposite sides of the power supply 4, an anode electrode bar 10 connected to the anode electrode of the power supply 4 and a cathode electrode bar 11 connected to the cathode electrode are disposed in opposed relationship with each other. The anode electrode bar and the cathode electrode bar used for the hair treatment tool according to the invention are by no means limitative, so long as they are made of carbon, manganese dioxide, lead dioxide, titanium, etc. and are generally used as electrode.

Figure 4:
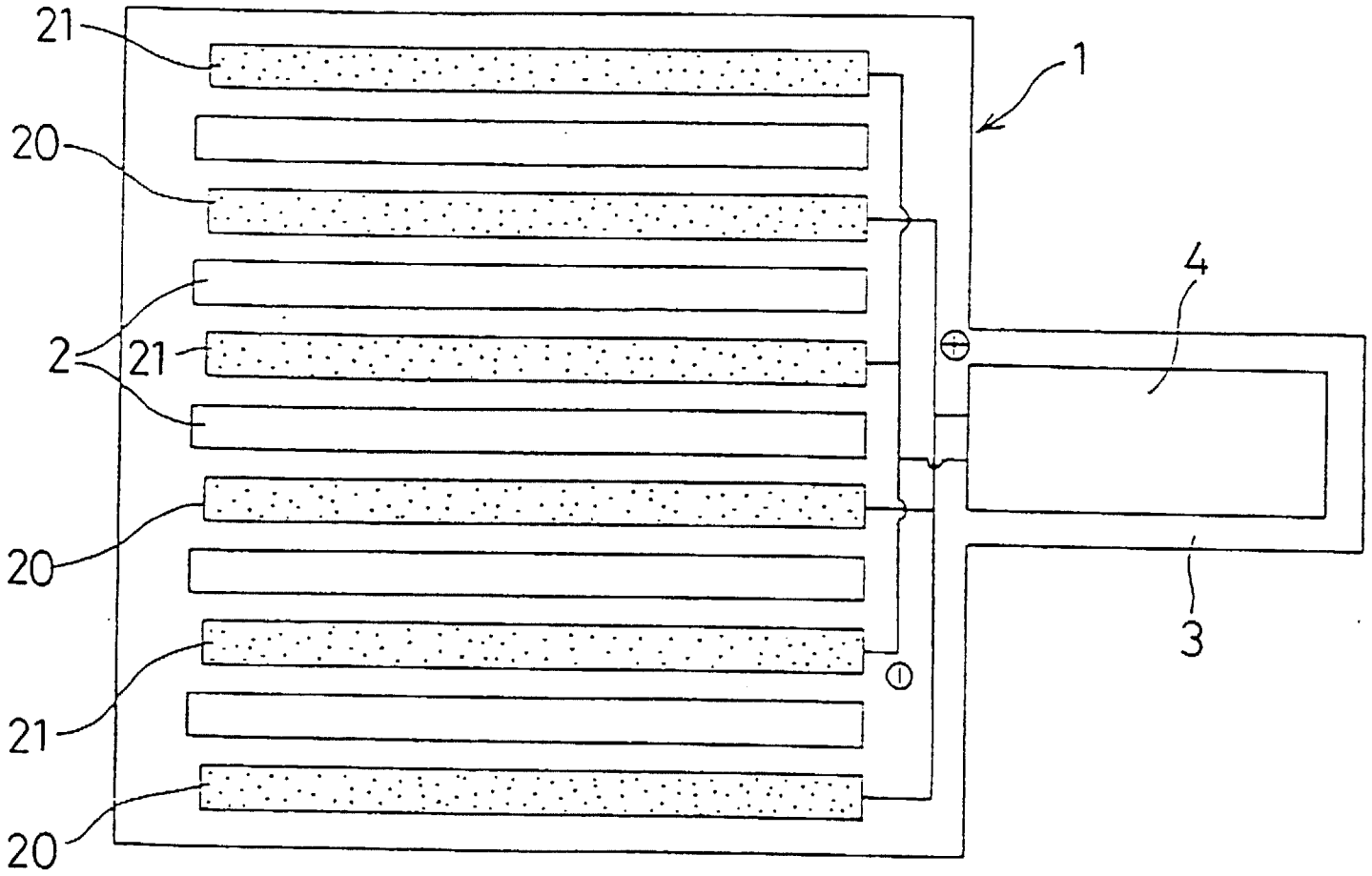
FIG. 4 is a plan view of a hair treatment tool according to another preferred embodiment of the invention.
Figure 5:
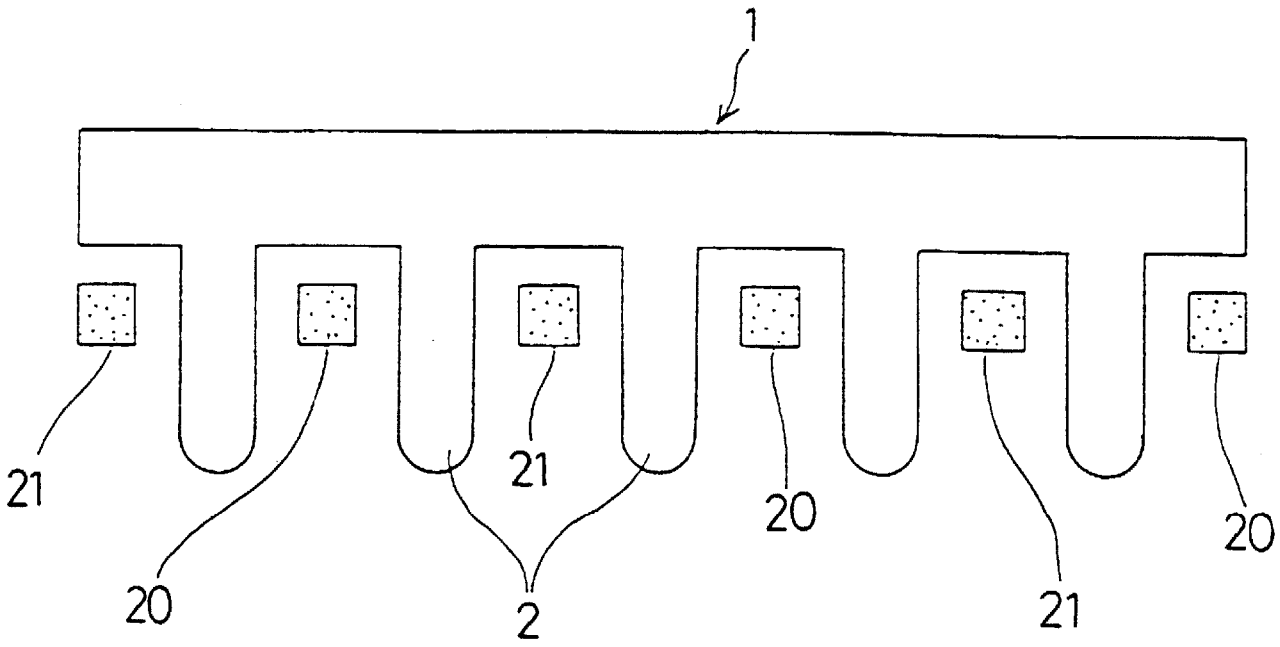
FIG. 5 is a side view thereof.

A brush-shaped tool as shown in FIGS. 4 and 5 can also be used suitably for the permanent waving treatment. The hair treatment tool shown in FIGS. 4 and 5 uses three symmetrical pairs of anode and cathode electrode bars 20 and 21, but this is by no means limitative; for instance, a similar brush-shaped tool (not shown) with anode and cathode electrode bars arranged alternately on the opposite sides of the comb section 2 can also be used suitably.

Figure 6:
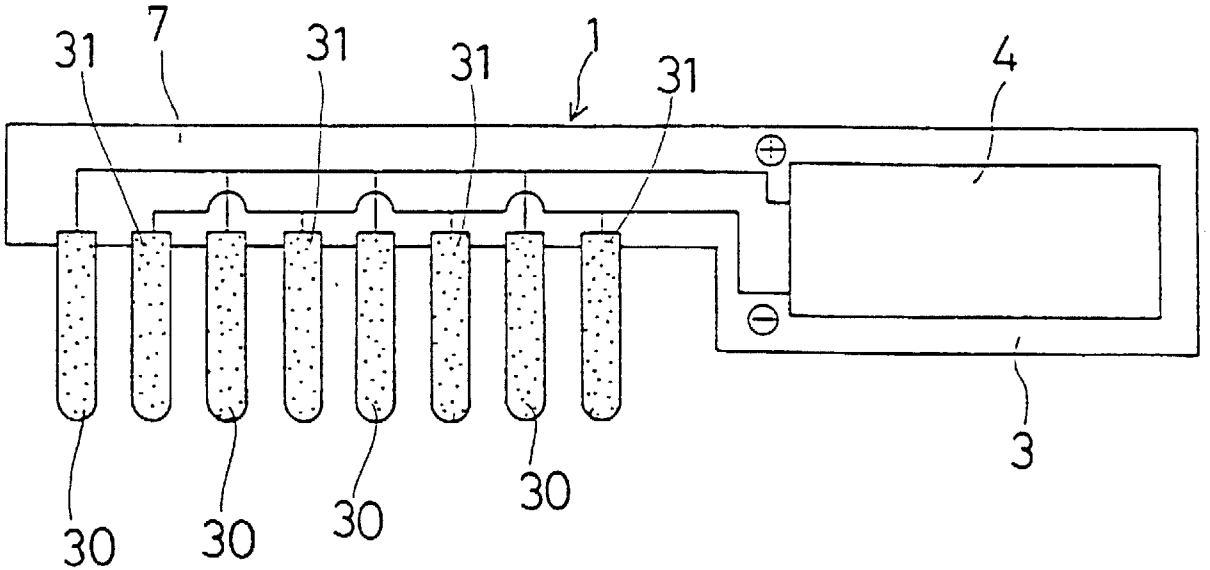
FIG. 6 is a front view of a hair treatment tool according to a further preferred embodiment of the invention.

A comb having the shape as shown in FIG. 6 can also be used suitably as the hair treatment tool according to the invention for the permanent waving treatment. The tool shown in FIG. 6 features that a number of anode and cathode electrode bars 30 and 31 corresponding in shape to teeth of a comb are disposed alternately on a base section 7 of the comb.

By brushing the whole hair with the first and second agents attached thereto by using either of the above hair treatment tools, current is caused to flow through the hair in contact with the anode and cathode electrode bars, so that the second agent having been applied to the hair is electrolytically treated to improve the oxidizing capacity. Thus, the whole hair can be quickly oxidization treated, thus greatly reducing the permanent waving time while suppressing damage to hair due to reducing treatment.

Figure 7:
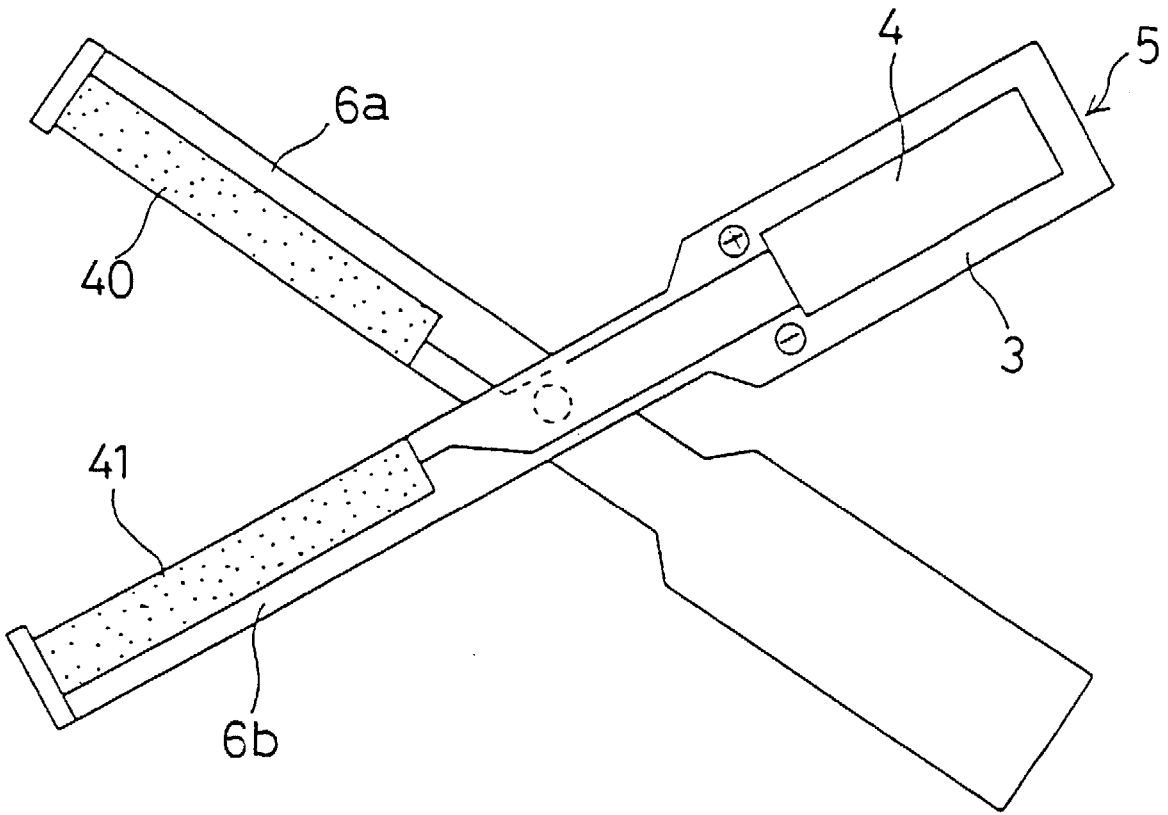
FIG. 7 is a front view of a hair treatment tool according to a still further preferred embodiment of the invention.

A hair iron as shown in FIG. 7 further can be suitably used as the hair treatment tool according to the invention for the permanent waving treatment to straighten curled hair. In the tool of this embodiment, an anode electrode bar 40 connected to the anode electrode side of power supply 4 is provided on the meshing or pinching surface of one pinching member 6*a*, and a cathode electrode bar 41 connected to the cathode electrode side of the power supply 4 is provided on the pinching surface of the other pinching member 6*b*. As in the comb-shaped hair treatment tools described before, the oxidizing capacity of the second agent having been applied to hair can be increased by pinching the hair between the pinching surfaces. Thus, the hair having been straightened by the pinching surfaces of the hair iron are directly oxidization treated in that state, so that new S—S bonds are formed in the keratin layer of the hair. Thus, stable straightening treatment of hair can be performed.

The electrolytic treatment as described above can cause a sudden change in the pH of the second agent (and/or first agent having been applied to the hair). This means that for carrying out the invention, it is suitable to add in advance a substance capable of alleviating the pH change to the second agent or the first agent to be electrolytically treated. For example, with ammonium hydrogencarbonate added in advance to the second agent, when hydroxyl ions causing pH increase are generated, the pH increase can be alleviated by the occurrence of a chemical reaction represented as:

$$2(NH_4)HCO_3+2OH^- \rightarrow (NH_4)_2CO_3+CO_3+2H_2O.$$

When the second agent having been applied to hair is electrolytically treated with the hair pinched in the hair treatment tool according to the invention, alkyltrimethyl ammonium chloride ($(CH_3)_3RNCl$), for instance, contained in the permanent waving chemicals, may bring about a reaction with halogen generated on the cathode electrode side represented as:

$$(CH_3)_3RNCl+Cl_2 \rightarrow (CH_3)_3RNCl_3$$

to form an insulating film, thus weakening the effect of the electrolytic treatment. Thus, when carrying out the invention, it is suitable to use chemicals not containing any substance which forms an insulating film on the electrode surface in the electrolytic treatment, such as alkyltrimethyl ammonium chloride. The selection of such chemicals is a matter of design for the person engaged in the art.

(2) Hair conditioning

The invention is applicable to various hair conditioning treatments. The hair treatment liquid used to carry out the invention may be any liquid so long as it is conductive and aqueous, such as hair conditioner for protecting damaged hair, hair rinse, hair conditioning cosmetic, and their blend liquid. Water containing a very small amount of electrolyte can also be used suitably for carrying out the invention.

Figure 9:
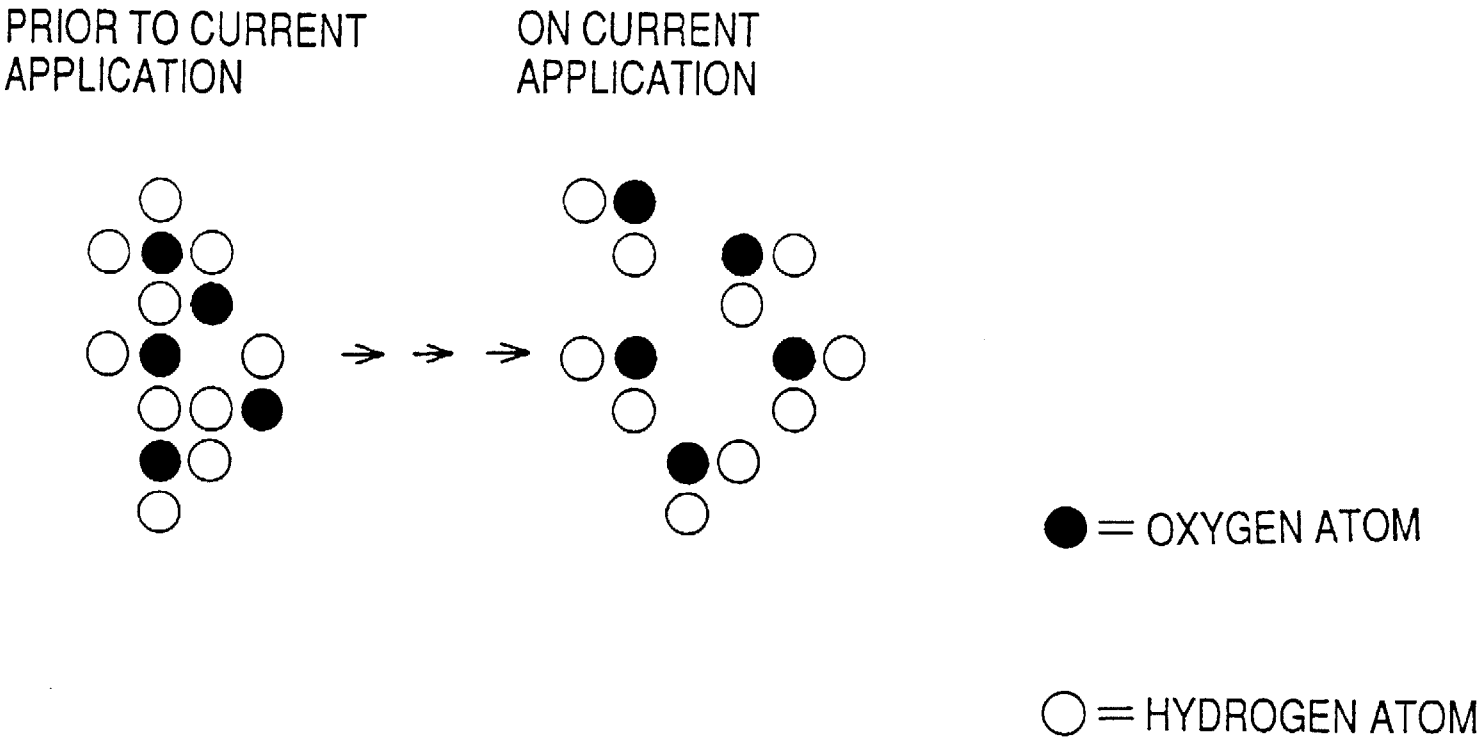
FIG. 9 is a schematic view illustrating dissociation of water molecules into independent molecules through current application.

The electrolytic treatment of the hair treatment liquid in carrying out the invention may be done in the manner as shown in (1) above. As shown in FIG. 9, molecules of active components in the hair conditioner for protecting damaged hair, hair rinse, etc. and/or water molecules are usually present in an associated state. The associated form of molecules is large in size and is difficult to permeate the keratin layer of hair. According to the invention, by passing minute current through the hair treatment liquid, the associated molecules can be dissociated into the state of independent presence of molecules (FIG. 1). Thus, by carrying out the hair treatment method according to the invention featuring the use of electrolytically treated hair treatment liquid, independent water molecules and/or active component molecules which are smaller in size than the associated form of molecules can permeate and be held in the keratin layer of hair, and thus the object (ii) noted above can be attained.

In a preferred form of the hair treatment method according to the invention, the electrolytic treatment is done on hair to which various hair treatment liquids have been applied. This form of hair treatment can be readily carried out by using either of the above hair treatment tools according to the invention.

For example, by brushing hair with a hair conditioner applied thereto using either of the comb- or brush-shaped tool shown in FIGS. 1 to 6 or treating the hair with the hair iron shown in FIG. 7, water molecules and/or active component molecules in the hair conditioner can be dissociated to permit independent water molecules and/or active component molecules smaller in size to quickly permeate the keratin layer of hair. The hair is thus wetted and thus brought to a smooth state, and this state can be maintained for a long time.

(3) Hair dyeing treatment

The invention further is suitably applicable to hair dyeing. Acidic hair dyes and oxidizing hair dyes can be suitably used to carry out the invention.

In carrying out the invention, the hair dye can be electrolytically treated substantially in the manners as described before in (1) and (2).

Figure 10:
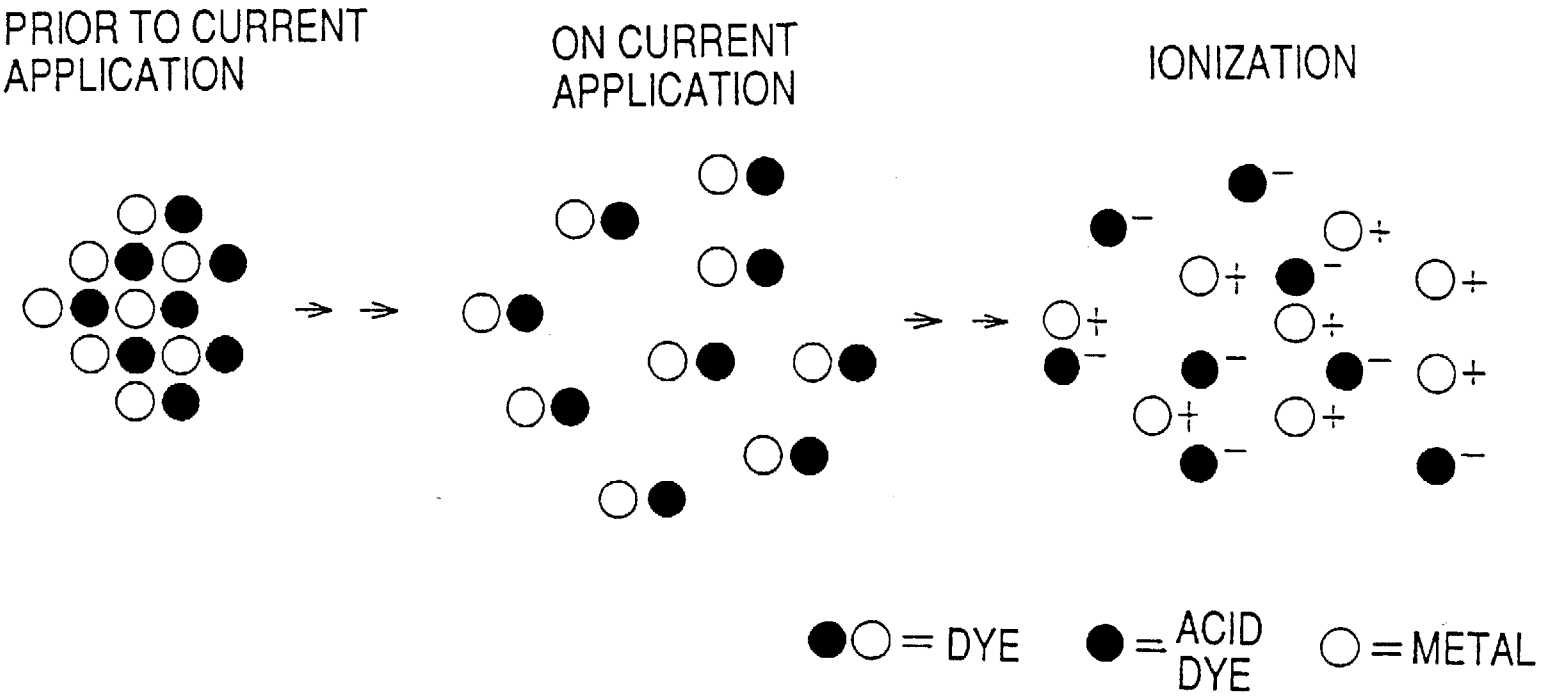
FIG. 10 is a schematic view showing dissociation of molecules of an acidic hair dye into ionization through current application.

As shown in FIG. 10, the pigment component contained in acidic hair dye, which is an anionic substance, is generally present in the form of a metal salt in the acidic hair dye, and its molecules are associated. The associated molecules are generally large in size so that they are difficult to permeate hair.

According to the invention, the associated molecules are dissociated by passing current through the acidic hair dye to bring about a state in which metal salt molecules are present as distinct molecules, and the pigment component is further dissociated (FIG. 10). Thus, by carrying out the hair treatment method according to the invention featuring the use of electrolytically treated acidic hair dye, the ionized pigment component can effectively penetrate and be held in the hair, and thus the object (iii) noted can be attained.

The oxidizing hair dye contains a color generating component (for instance, pyrogallol) which is featured by color generation when it is oxidized. However, when resort is had to natural oxidizing action in air, several hours are required until the dye is completely oxidized to generate color.

According to the invention, the oxidizing action of the acidic hair dye can be promoted electrically by minute current passed through the dye. Thus, by carrying out the hair treatment method according to the invention featuring the use of an electrolytically treated acidic hair dye, the hair dyeing can be quickly completed.

In a further preferred form of the hair treatment method according to the invention for hair dyeing, the electrolytic treatment is done on the hair with the dye having been applied thereto. This form of hair treatment can be readily carried out by using any of the hair treatment tools described above according to the invention.

For example, by brushing the hair with the acidic hair dye applied thereto with any comb- or brush-shaped tool shown in FIGS. 1 to 6, associated metal salt containing the dye pigment component can be dissociated into independent molecules of a smaller size, and further the pigment component can be ionized so that it can quickly permeate the keratin layer of hair. The hair thus can be dyed uniformly. As another example, by brushing hair with acidic hair dye applied thereto by using any comb- or brush-shaped tool shown in FIGS. 1 to 6, the pH in the neighborhood of the cathode electrode is increased to become alkaline, and further oxygen is generated at the anode electrode bar. Thus, quick oxidization of pyrogallol or like pigment component can be obtained. As a result, hair dyeing which has heretofore required several hours can be completed in only about 10 to 20 minutes.

(4) Hair treatment for removal of sanitary vermin such as ticks and lice

In addition the above typical forms of hair treatment, the hair treatment method according to the invention featuring electrolytic treatment of hair treatment liquid on hair and also the hair treatment tool used for the same method can be used effectively for hair treatment used for removal of ticks, lice, etc. living in the hair of animals including man.

As hair treatment liquid in carrying out the invention, an aqueous solution containing a very small amount of electrolyte can be suitably used. Also suitable as hair treatment liquid in carrying out the invention are residual liquid remaining in hair having been shampooed or aqueous hair rinse after hair washing.

In carrying out the invention, the current for electrolytically treating the hair treatment liquid may be minute; for instance, it may be a DC current generated with a voltage of about 6 V. Such vermin as ticks can be electrically shocked to death by the current when the hair is conditioned.

The hair treatment to this end can be readily carried out by using any hair treatment tool described above according to the invention.

For example, when brushing hair with an aqueous hair conditioner containing an adequate amount of electrolyte applied thereto with the hair treatment tool of the shapes shown in FIGS. 1 to 7 according to the invention or pinching the hair between the electrodes (i.e., anode and cathode electrode bars), the tool is energized, so that current is passed through the hair which has intrinsically been an insulator. Thus, while the hair is conditioned, minute harmful vermin such as ticks and lice can be eliminated by the current. From the standpoint of simultaneously doing the hair conditioning and harmful vermin elimination after hair washing, the above hair treatment is suitably done right after the shampooing.

EXAMPLE

The following example illustrates the method for and tool of hair treatment according to the invention applied to permanent straightening treatment of hair without any sense of limiting the scope of the invention.

The first agent, i.e., a creamy permanent waving agent, was applied to the whole treatment hair. This treatment took about five minutes. Subsequently, the hair was left for 10 minutes, and then the second permanent waving agent was applied to the hair while combing the hair with a comb. This treatment took about five minutes. Then, the hair was combed using the tool shown in FIG. 4 by energizing the same with a voltage not exceeding 12 V for 5 to 10 minutes. Then, the hair was washed to complete the permanent straightening process. By this process, the hair was completely straightened.

In this example, the permanent straightening process was completed in 25 to 30 minutes. This time was about one-third of the time required in the whole process by the prior art method (i.e., 70 to 100 minutes). In the above process, the first and second agents were each used in about 45 ml. This amount was one-third to one-half the amount required in the process by the prior art method (100 to 120 ml). No pronounced damage was recognized in the treated hair. In addition, no odor of the chemicals remained.

As shown, according to the invention, the permanent waving treatment could be done without need of any special skill which was necessary in the prior art.

According to the invention, the oxidizing capacity of the oxidizing agent contained in the permanent waving agent (i.e., second agent) can be increased to promote the oxidizing action, thus permitting quick restoration of S—S bonds between keratin molecules of hair having been cut by the permanent waving agent (first agent). Thus, according to the invention, it is possible to provide a method of and a tool for hair treatment which can curtail the treatment time and suppress damage to hair due to reducing treatment.

Also, according to the invention, the oxidizing action of the oxidizing dye can be promoted to effect hair dyeing in a short period of time. Further, the pigment component in the acidic dye can be ionized, thus permitting quick permeation of hair by the dye component in the acidic dye. Thus, according to the invention, it is possible to provide a hair dyeing method in which high dyeing efficiency and long dye retention can be attained, and a hair treatment tool to this end.

Furthermore, according to the invention, molecules of active components in various hair treatment liquids can be dissociated to permit quick permeation of hair by the active components now in the state of independent small size molecules. According to the invention, it is thus possible to provide a hair treatment method which permits high effect of hair conditioning such as cares of damaged hair and a hair treatment tool used for the same method.

Moreover, according to the invention, it is possible to provide a method for and a tool of hair treatment having an effect of eliminating such vermin as ticks and lice.

While the invention has been described with reference to preferred embodiments thereof, it is to be understood that modifications or variations may be easily made without departing form the scope of the present invention which is defined by the appended claims.

What is claimed is:

1. A hair treatment tool substantially made of an insulating material and comprising at least one set of an anode electrode bar and a cathode electrode bar, both connected to a power supply, the anode and cathode electrode bars being conducted such that the hair treatment liquid applied to the hair having existed between the electrode bars is treated without heating the hair.

2. The hair treatment tool according to claim 1, which is in the form of a hair iron substantially made of an insulating material, the anode electrode bar being disposed on a pinching surface of one of pair pinching members, the cathode electrode bar being disposed on a pinching surface of the other pinching member.

3. A method of hair treatment comprising the steps of applying a hair treatment liquid to hair, and then passing current through the hair such that the applied hair treatment liquid is electrolytically treated without heating the hair.

4. The method of hair treatment according to claim 3, wherein the oxidizing capacity of the hair treatment liquid is increased by the electrolytic treatment.

5. The method of hair treatment according to claim 3, wherein the electrolytic treatment causes dissociation of molecules contained in the hair treatment liquid and/or ionization of the molecules.

6. The method of hair treatment according to claim 3, wherein the hair treatment liquid is selected from the group consisting of hair conditioner, acidic hair dye, oxidizing hair dye and neutralizing agent for permanent hair waving treatment.

7. A method of hair treatment comprising the steps of using a hair treatment tool substantially made of an insulating material and including at least one set of an anode electrode bar and a cathode electrode bar both connected to a power supply, the hair having been imparted with conductivity and having existed between the electrode bars to electrolytically treat the hair treatment liquid applied to the hair by passing current through the hair without heating the hair.

* * * * *